US006565046B2

(12) United States Patent
Uebel

(10) Patent No.: US 6,565,046 B2
(45) Date of Patent: May 20, 2003

(54) METHOD OF DETECTING OBSTACLES ON RAILROAD LINES

(75) Inventor: Helmut Uebel, Leonberg (DE)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/726,039

(22) Filed: Nov. 30, 2000

(65) Prior Publication Data

US 2001/0002688 A1 Jun. 7, 2001

(30) Foreign Application Priority Data

Dec. 4, 1999 (DE) ..... 199 58 634

(51) Int. Cl.[7] ..... B61L 23/00

(52) U.S. Cl. ..... 246/120; 246/167 R; 246/473 R; 246/477; 246/473.1; 701/301

(58) Field of Search ..... 246/1 C, 3, 167 R, 246/111, 473 R, 113, 114 R, 115, 120, 121, 166, 473.1, 477; 348/143, 145; 701/19, 301

(56) References Cited

U.S. PATENT DOCUMENTS

| | | | | |
|---|---|---|---|---|
| 5,785,283 A | * | 7/1998 | Ehrenberger et al. | 246/62 |
| 5,825,412 A | * | 10/1998 | Hobson et al. | 348/143 |
| 6,285,949 B1 | * | 9/2001 | Roediger | 701/117 |

FOREIGN PATENT DOCUMENTS

| | | | |
|---|---|---|---|
| DE | 196 21 612 A1 | | 12/1997 |
| EP | 0 560 314 A1 | | 9/1993 |
| EP | 0 749 098 A2 | | 12/1996 |
| JP | 03 148 373 A1 | | 6/1991 |
| JP | 06 080 082 A1 | | 3/1994 |
| JP | 07 228 250 A1 | | 8/1995 |
| JP | 08 133 085 A1 | | 5/1996 |
| JP | 08 180 276 A1 | | 7/1996 |
| WO | WO 97/31810 | * | 9/1997 |

OTHER PUBLICATIONS

Suzan, P.; Schurmans, P.: "Gefahrenraumfreimeldung mit Radarscanner" In: Signal u. Draht, 1999, Heft 6, pp. 23–27.

* cited by examiner

*Primary Examiner*—Mark T. Le
(74) *Attorney, Agent, or Firm*—Sughrue Mion, PLLC

(57) ABSTRACT

A method and system of detecting obstacles on railroad lines. Sensors for observing the railroad line are arranged along the railroad line, and automatic evaluation takes place. One advantage of the invention is that the railroad lines are divided into given, known line sections, each of which is monitored by a respective sensor, whereby the evaluation process is simplified. If the sensors are designed as video cameras, for example, a comparison with still images may suffice for the evaluation. Furthermore, as the line sections re known, a simple masking technique can be used. Obstacles outside a set route to be monitored are masked out using suitable masks.

14 Claims, 1 Drawing Sheet

METHOD OF DETECTING OBSTACLES ON RAILROAD LINES

BACKGROUND OF THE INVENTION

This invention relates to a method of detecting obstacles on railroad lines.

In manually controlled rail vehicles, it is incumbent upon the driver to continuously check whether the track ahead is free, and to initiate safety reactions if necessary. In automatically controlled, driverless rail vehicles, this function must be performed in a different manner. One possible solution is to design the route in such a way that no obstacles can occur. This can be accomplished through the use of elevated track beam structures, tunnels, or fences. Aside from subway systems, where tunnel construction is an inherent requirement, implementation is very costly. Another solution is to replace the observation performed by the driver by automatic obstacle detection from the train. Considerable problems may arise in curves, at entries into stations due to standing trains, and in the case of obstacles close to the route. Due to obstructions of view, obstacles are perceived so late that stopping of the train before the obstacle to avoid a collision is no longer possible. In addition, complex and expensive evaluation electronics are necessary to be able to perform a reliable evaluation of moving images of an unknown route at speeds in excess of 200 km/h.

SUMMARY OF THE INVENTION

It is therefore an object of the invention to provide a method of detecting obstacles on railroad lines which does not have the above disadvantages.

This object is attained by a method of detecting obstacles on railroad lines for automatically controlled, driverless rail vehicles, wherein sensors operating in the optical range, the infrared range or the radio-wave range are arranged along the railroad lines for observing the respective routes ahead of the automatically controlled, driverless rail vehicles traveling on the railroad lines, and wherein an automatic evaluation of the sensor output signals is performed which is used at least in part to control the automatically controlled, driverless rail vehicles.

One advantage of the invention is that the railroad lines are divided into given, known line sections, each of which is monitored by a respective sensor, whereby the evaluation process is simplified. If the sensors are designed as video cameras, for example, a comparison with still images may suffice for the evaluation.

Furthermore, as the line sections are known, simple masking can be performed. Obstacles outside a set route to be monitored are masked out using suitable masks.

The components required to carry out the method need to be installed essentially only once along the railroad lines rather than on all trains. Use can be made of existing components such as masts and telecommunications and power cables laid along the railroad lines. This provides a saving in cost, particularly at high train densities.

In a preferred embodiment of the invention, automatic obstacle detection is used as a substitute for or in addition to "line-clear" signaling. Conventional "line clear" signaling methods use axle counters. The axle counters count the axles of a passing train. One axle counter is located at the beginning of a line section to be monitored, and another at the end. If the axle counter at the beginning registers a train entering the line section, the latter will be closed for further trains. If the axle counter at the end registers a train leaving the line section, the latter will be cleared. Instead of or in addition to this relatively costly and complicated technique, automatic obstacle detection can be used. Automatic obstacle detection is coupled with a "line-clear" signaling facility. If no obstacles are detected, the respective line section will be cleared automatically.

Another advantage of the invention is that obstacles of any kind can be detected. This also includes persons on the railroad tracks, so that attempted sabotage, for example, can be detected at an early time and appropriate measures can be taken.

By the arrangement of sensors along the railroad lines, all available railroad lines can be monitored simultaneously. This makes it possible to detect obstacles at the earliest possible time. Appropriate measures to remove the obstacles can be taken at the earliest possible time. Delays caused by obstacles are thus minimized.

If video cameras are used for the sensors, these can be rigidly or movably mounted, for example. Furthermore, remote control can be implemented. From a center, a person can select one camera, for example the one that has just detected an obstacle and is drawing attention to itself by, e.g., an audible and/or visual alarm signal. The person can then remotely pan the camera, operate the zoom of the camera, and bring the object into focus.

BRIEF DESCRIPTION OF THE DRAWINGS

An embodiment of the invention will now be explained with reference to the accompanying drawings.

DETAILED DESCRIPTION OF THE INVENTION

Figure 1:
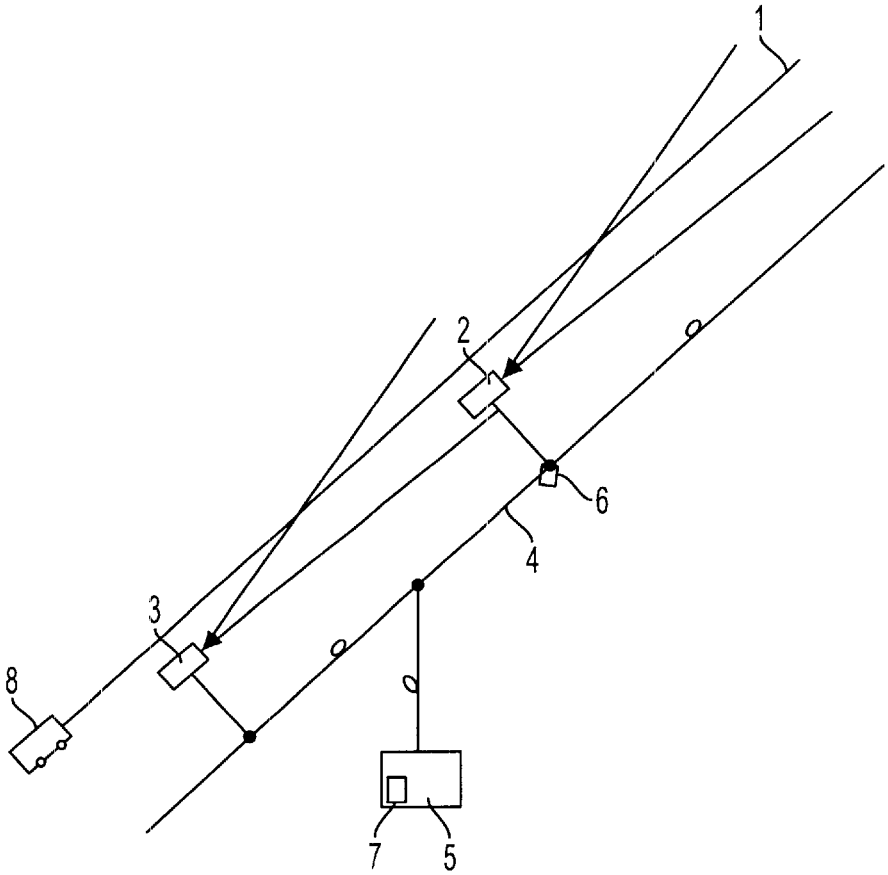
FIG. 1 of the drawings shows a stretch of railroad line in accordance with the invention.

Referring to FIG. 1, the line stretch 1 forms part of a line of a subway system or urban rapid-transit system. Vehicles are assumed to travel on the line under automatic control and without a driver. This necessitates, among other things, obstacle detection. Arranged along the line are sensors that observe the line. In this embodiment, two sensors 2, 3 are shown, each of which observes a respective line section. Sensors 2, 3 are designed as video cameras. The video cameras take still images. They are connected by an optical line 4 to a center 5. Optical line 4 is a glass fiber optic line, for example. Center 5 comprises a processor and a memory, for example.

The images taken by the video cameras are transmitted over optical line 4 to center 5. Each video camera is assigned an address, which is transmitted along with the images so as to be able to sort the images received at center 5. Before transmission, each video camera can subject the images taken to a data compression. The camera signals are converted from electrical to optical form before being transmitted. The images of all video cameras are transmitted to center 5 using time-division multiplexing, for example. On optical line 4, high transmission capacity is available, so that only minimum delays occur. At center 5, images from all video cameras are centrally evaluated. To do this, center 5 compares the current images with reference images. If no difference is detected between a current still image and a reference image, the respective line section is free of obstacles. If a difference is detected, the difference corresponds to the obstacle. In addition to the detection of an obstacle, a classification of the obstacle can be made. To accomplish this, typical obstacles are stored as images in a memory. Typical images are, for example, a train, a fallen tree trunk, an animal. A comparison of a detected obstacle with a stored image can result in early, automatic classification of the detected obstacle, so that different measures can be taken to remove the obstacle.

In evaluating the still images, use can be made of masking. Through a comparison with the route of a particular train, which is available at the center 5, nonrelevant obstacles, such as opposing trains, can be masked out. For each line section with at least two parallel tracks, one for one direction and another for the opposite direction, one or more sensors can be used. If one sensor is used, each transmitted still image will be separated into a number of still images equal to the number of tracks. In each separated still image, one route will be masked and an evaluation will be performed for this route. If two or more sensors are used, redundancy and safety are increased. Each sensor is essentially pointed at, and provided for monitoring, one track. As the tracks are in close proximity to each other, masking of individual routes will be necessary during evaluation. The data volume to be transmitted is determined by the number of sensors. The more sensors are used, the more data will have to be transmitted. The fields of view of the sensors overlap. Particularly if one sensor fails, the still image taken by an adjacent sensor can be used to evaluate the route to be monitored by the failed sensor. This enhances safety. In railway control it is common practice to make a "two-out-of-three decision" in order to enhance safety. For example, three sensors with nearly the same angle of view can be mounted parallel to each other on one mast. All three sensors transmit to center 5 still images taken at the same time. If the evaluation of at least two still images indicates an obstacle, the detection of an obstacle will be signaled. If the evaluation of at least two still images indicates no obstacle, the detection of no obstacle will be signaled.

By taking the route into account, the monitoring of individual line sections can take place already before a train is allowed into a given line section. If there are any doubts as to whether an obstacle is obstructing the flow of traffic, an alarm will be triggered and a person can check the situation and decide on clearance or closure on the basis of a monitor image.

Sensors 2, 3 are designed to be remotely controllable from center 5. Control is effected over optical line 4. The control comprises, for example, panning the sensors 2, 3. To accomplish this, a motor is provided at the respective sensor. Furthermore, each sensor 2, 3 comprises a zoom. By remotely operating the zoom, portions of the field of view can be shown enlarged. On the occurrence of an obstruction, an operator can locate and call the sensor 2, 3 having detected the obstruction from center 5, establish a real-time connection, and remotely control this sensor. The selection of a sensor 2, 3 is made via optical line 4 by transmitting the address of sensor 2, 3. After reception of a corresponding predetermined signal, sensor 2, 3 switches to continuous operation. A real-time connection is established to center 5. Center 5 has a control desk with several monitors and a diagram showing the locations of the routes and the sensors 2, 3. By the real-time transmission, consecutive still images are transmitted to center 5. If video cameras are used for the sensors, the operator will then see a real-time video of the disturbed line section on a monitor. Optionally, sound is transmitted as well. By panning the camera and zooming under remote control, the operator can bring the obstacle to focus so as to be able to better see and identify it and then initiate suitable measures.

By connecting center 5 to a track release facility, individual line sections can be closed after automatic detection of an obstacle. The function of the track release facility is to clear or close individual line sections. This is accomplished using axle counters, for example. In addition, a line section will now also be closed if a camera monitoring this section detects an obstacle. After evaluation at center 5, a corresponding signal, e.g., a previously known, stored alarm signal or operating signal will be automatically transmitted to the track release facility. The latter receives the signal and thereupon closes the line section. If the track release facility is responsible for closing and clearing two or more line sections, center 5 will additionally transmit information about the respective line section to be closed. After removal of the obstacle, the line section will be cleared.

In curves and other critical areas, sensors may be spaced shorter distances from each other than in areas in which the tracks run in a straight line. In a preferred embodiment of the invention, the automatic obstacle detection using lineside sensors 2, 3 is combined with on-board obstacle detection. In straight-line areas, on-board obstacle detection has advantages, so that no lineside sensors will be used in these areas and obstacle detection will be performed exclusively by the trains themselves. This will save installation and maintenance costs in generally sparsely populated, rural areas. In curves and other critical areas, i.e., generally in urban areas with high train density, sensors 2, 3 will be installed along the railroad line. Via center 5, which communicates with the trains by radio or via beacons, for example, data about clearance and closure of individual line sections are transmitted. If a sensor 2, 3 detects an obstacle, the associated line section will be closed and the approaching train will be notified by center 5.

In the embodiment, video cameras operating in the optical range are used for the sensors. It is also possible to use sensors that operate in the infrared range or in the radio-wave range (radar). Through the use of these ranges, the observation becomes largely independent of the weather.

In the embodiment, the evaluation of the still images is performed at a central location, namely at the center. The sensors can thus be of a simple, low-cost design. In view of the great number of sensors required, the cost of implementing the overall system can thus be kept low. To preclude manipulations, a time stamp may be added to each transmission. Instead of being performed at the center, the evaluation may take place wholly or in part in the sensors. If each sensor includes a processor and a memory, it can compare current still images with a stored reference image and perform the obstacle detection for a line section autonomously. The result of the comparison is communicated to the center, for example, which then initiates further steps. The transmission volume can be reduced if normally, i.e., with no obstacle present, only a status message, such as OK, is transmitted, while in the event of disturbance, i.e., upon detection of an obstacle, the corresponding still image is transmitted. Instead of or in addition to being transmitted to the center, the still image or an alarm message may, in the event of a disturbance, also be transmitted directly to a train that is approaching the line section. Transmission is by radio or via beacons, for example. In this way, the train receives current and nearly undelayed alarm messages and can then initiate a braking process.

In the embodiment, an optical line is used between the sensors and the center. It is also possible to use an electric line, a radio link, or a power line. With the electric line, no electrical-to-optical conversion is necessary, so that the sensors can be manufactured at even lower cost. In addition, electric lines are already available along most railroad lines, so that new installation is not necessary. The electric lines are used, for example, to transmit the axle counter signals. The transmission takes place in accordance with a specified transmission protocol. The protocol can be additionally used for the transmission of the sensor signals. This eliminates the need to develop a new protocol. For radio transmission, the Global System for Mobile Communications (GSM) can be used. GSM is already being used as a transmission medium for communication between trackside equipment and rail vehicles. Transmission takes place according to a specified protocol that can also be used for the transmission of the sensor signals. In addition, direct communication between sensor and rail vehicle is possible. If a power line is employed, it can be used both for feeding the sensors and for transmitting the sensor signals.

In the embodiment, the transmission of the sensor signals to the center is time-division multiplex. It is also possible to use frequency-division multiplexing or code-division multiplexing. Alternatively, use can be made of a so-called ALOHA method in which the center polls the individual sensors in succession. With an intelligent control, the center may, for instance, poll only those sensors which observe line sections that are used for current train traffic. This reduces propagation delays and the transmission volume.

Figure 2:
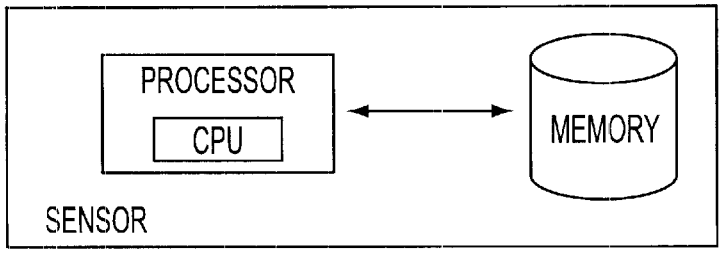
FIG. 2 of the drawings shows a sensor with a processor and a memory.

In an arrangement, as shown in FIG. 2, a processor and a memory are provided in each of the sensors.

What is claimed is:

1. A method of detecting obstacles on railroad lines for automatically controlled, driverless rail vehicles, said method comprising the steps of:

arranging sensors along the railroad lines, such that the sensors provide overlapping fields of view along a majority of a railroad line between two stations, which sensors operate in an optical range, an infrared range, or a radio-wave range;

observing routes ahead of the automatically controlled, driverless rail vehicles traveling on the railroad lines; and automatically evaluating the sensor output signals, the automatic evaluation controlling, at least in part, the automatically controlled, driverless rail vehicles.

2. A method of detecting obstacles on railroad lines for automatically controlled, driverless rail vehicles, said method comprising:

arranging along the railroad lines sensors which operate in an optical range, an infrared range, or a radio-wave range;

observing routes ahead of the automatically controlled, driverless rail vehicles traveling on the railroad lines; and automatically evaluating the sensor output signals, the automatic evaluation controlling, at least in part, the automatically controlled, driverless rail vehicles, characterized in that the sensors are designed as video cameras which take still images, that a processor and a memory are provided in each of the sensors, and that each of the sensors is adapted to compare a current still image with a stored reference image and to perform the obstacle detection for a line section autonomously.

3. A method according to claim 2, characterized in that when no obstacle is detected, the sensor output signals contain a status message, and that when an obstacle is detected, the sensor output signals contain the corresponding current still image.

4. A method as claimed in claim 1, characterized in that the sensors are remotely controllable.

5. A method as claimed in claim 1, characterized in that each sensor output signal contains a time stamp.

6. A method as claimed in claim 1, characterized in that at least part of results of the evaluation are automatically transferred by radio or via beacons to at least one automatically controlled, driverless rail vehicle.

7. A method as claimed in claim 1, characterized in that at least part of results of the evaluation are automatically transferred to at least one track release facility, and that depending on the results received, each track release facility clears or closes particular railroad line sections.

8. A method as claimed in claim 1, characterized in that the sensors are designed as video cameras which take still images that are transmitted to a center, and that at the center the received still images are evaluated by a comparison with reference images.

9. A railroad line abnormal condition detection system, comprising:

sensors arranged at posts along railroad lines, said sensors operating in an optical range, an infrared range, or a radio-wave range, the sensors providing overlapping fields of view and observing a majority of a route of rail vehicles traveling on the railroad lines; and a center coupled to said sensors by optical or electric lines, radio links, or power lines, the center being adapted to perform an evaluation of output signals of all the sensors centrally, the evaluated sensor output signals controlling, at least in part, the rail vehicles.

10. A system as claimed in claim 9 characterized in that the center is adapted to communicate with automatically controlled, driverless rail vehicles traveling on the railroad lines by radio or via beacons, and to clear or close particular line sections depending on the results of the evaluation.

11. A system as claimed in claim 9, characterized in that the sensors include video cameras which take still images that are transmitted to the center using multiplexing, with each sensor being assigned an address, and each transmission of a still image including the address of the associated sensor.

12. A system, for carrying out the method of claim 1, characterized in that automatically controlled, driverless rail vehicles and sensors are provided, such that the sensors are arranged along the railroad line and operate in an optical range, an infrared range, or a radio-wave range, to observe routes ahead of automatically controlled, driverless rail vehicles traveling on the railroad lines, and that the sensors are adapted to communicate with the automatically controlled, driverless rail vehicles traveling on the railroad lines by radio or via beacons.

13. A method of detecting an abnormal condition on a railroad line comprising:

picking up route data in sensors arranged along said railroad lines such that the sensors provide fields of view along a substantial portion of a railroad line, said sensors operating in an optical range, an infrared range or a radio-wave range;

evaluating said route data based on a route masking technique to detect an obstacle or said abnormal condition; and transmitting a signal according to a result of the evaluation to a rail vehicle or a center, wherein said sensors provide fields of view of a majority of route.

14. A system of detecting an abnormal condition on a railroad line comprising:

means for picking up route data in sensors arranged at posts along the railroad line such that the sensors provide overlapping fields of view along a majority of a railroad line between two stations, said sensors operating in an optical range, an infrared range or a radiowave range;

means for evaluating said route data based on a route masking technique to detect an obstacle or said abnormal condition; and means for transmitting a signal according to a result of the evaluation to a rail vehicle or a center.

* * * * *